US009770717B1

(12) United States Patent
Delamarche et al.

(10) Patent No.: US 9,770,717 B1
(45) Date of Patent: Sep. 26, 2017

(54) MICROFLUIDIC CHIP WITH BEAD INTEGRATION SYSTEM

(71) Applicant: International Business Machines Corporation, Armonk, NY (US)

(72) Inventors: Emmanuel Delamarche, Thalwil (CH); Michel Lim, Zurich (CH); Yuksel Temiz, Zug (CH)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 15/342,403

(22) Filed: Nov. 3, 2016

(51) Int. Cl.
*B01L 3/00* (2006.01)

(52) U.S. Cl.
CPC ..... *B01L 3/502761* (2013.01); *B01L 3/50273* (2013.01); *B01L 3/502707* (2013.01); *B01L 3/502715* (2013.01); *B01L 2200/0668* (2013.01); *B01L 2200/0689* (2013.01); *B01L 2200/12* (2013.01); *B01L 2300/041* (2013.01); *B01L 2300/0816* (2013.01); *B01L 2300/0838* (2013.01); *B01L 2300/0848* (2013.01); *B01L 2400/0406* (2013.01)

(58) Field of Classification Search
CPC ..... B01L 3/502723; B01L 3/5027; B01L 3/50273; B01L 3/502746; B01L 3/502753; B01L 3/502761
See application file for complete search history.

(56) References Cited

U.S. PATENT DOCUMENTS

2003/0096081 A1* 5/2003 Lavallee ..... B01F 13/0059 428/138
2011/0243790 A1* 10/2011 Cheung ..... G01N 15/0612 422/52
2011/0312518 A1 12/2011 Davis et al.
2013/0157283 A1 6/2013 Yung et al.
2014/0332098 A1* 11/2014 Juncker ..... B01L 3/50273 137/511

OTHER PUBLICATIONS

Liu, Hao-Bing et al. "Manipulating liquid plugs in microchannel with controllable air vents." Biomicrofluidics (2012) 6 012815.*
Lo et al., "Get to Understand More from Single-Cells: Current Studies of Microfluidic-Based Techniques for Single-Cell Analysis", Int. J. Mol. Sci. 2015, 16, Jul. 23, 2015, pp. 16763-16777.
Price et al., "Microfluidic Bead Suspension Hopper", Anal. Chem., 2014, 86 (10), pp. 5039-5044.

* cited by examiner

*Primary Examiner* — Christopher A Hixson
(74) *Attorney, Agent, or Firm* — Cantor Colburn LLP

(57) ABSTRACT

The present invention is notably directed to a microfluidic chip. The chip comprises a main microfluidic channel, on one side of the chip, and a bead integration system. The bead integration system is arranged on said one side of the chip. It comprises an auxiliary microfluidic channel transverse to and in fluidic communication with the main microfluidic channel, so as to form an intersection therewith. The intersection is delimited by structural elements arranged in the main microfluidic channel. The structural elements are configured to retain, at said intersection, beads flowed in a bead suspension liquid advancing in said auxiliary microfluidic channel and passing the intersection. In addition, such structural elements are configured to let liquid advancing in the main microfluidic channel pass the intersection through the structural elements. The invention is further directed to related devices and methods.

24 Claims, 4 Drawing Sheets

MICROFLUIDIC CHIP WITH BEAD INTEGRATION SYSTEM

BACKGROUND

The invention relates in general to the field of microfluidics, microfluidic chips, and devices and methods to integrate receptors into a microfluidic device.

Microfluidics deals with the behavior, precise control and manipulation of small volumes of fluids that are typically constrained to micrometer-length scale channels and to volumes typically in the sub-milliliter range. Prominent features of microfluidics originate from the peculiar behavior that liquids exhibit at the micrometer length scale. Flow of liquids in microfluidics is typically laminar. Volumes well below one nanoliter can be reached by fabricating structures with lateral dimensions in the micrometer range. Reactions that are limited at large scales (by diffusion of reactants) can be accelerated. Finally, parallel streams of liquids can be accurately and reproducibly controlled, allowing for chemical reactions and gradients to be made at liquid/liquid and liquid/solid interfaces.

Microfluidic devices generally refer to microfabricated devices, which are used for pumping, sampling, mixing, analyzing and dosing liquids. Instead of using active pumping means, microfluidic devices are known, which use capillary forces for moving a liquid sample inside the microfluidic device. This makes the device simpler to operate and less expensive because there is no need for integrated or external (active) pump. However, particulates, contamination and other issues during manufacture can compromise capillary-based filling of the device.

Microfluidic devices for point-of-care diagnostics are devices meant to be used by non-technical staff, near patients or in the field, and potentially at home. Existing point-of-care devices typically require loading a sample onto the device and waiting a predefined time until a signal (usually optical or fluorescence signal) can be read. The signal originates from (bio)chemical reactions and relates to the concentration of an analyte in a sample. These reactions may take time and be difficult to implement because they require optimal timing, flow conditions of sample and accurate dissolution of reagents in the device. The reactions typically involve fragile reagents such as antibodies. Air bubbles may be created in the device, which can invalidate the test. In addition, debris in a device can block liquid flows. In devices where liquids must be split in parallel flow paths, filling may not occur at the same flow rate and this can bias or invalidate the tests.

In many analytical devices, receptors need be localized in an area of the device for binding and accumulating analytes in view of their detection. The localization of receptors is a challenging problem, in particular for mass manufacturing devices at a reasonable cost. In particular, when analytical devices need be closed, it is sometimes difficult to introduce receptors inside areas of the device. For capillary-active devices, an additional difficulty is to control the flow of solutions containing receptors and to avoid spreading of such solutions.

The localization of receptors can be done using lithography. Such a technique, however, is expensive, slow, and may lack flexibility and compatibility with fragile receptors such as antibodies. Spotting can also be used (e.g., inkjet, pin or quill spotting). However, such a technique leads to spreading of liquids, drying artefacts, aggregation and uneven distribution of receptors. Another technique commonly used is the local dispensing of a solution containing receptors on porous media such as paper or cellulose. This, however, leads to a lack of resolution and uneven receptor density that hinder multiplexing, miniaturization, and signal quantitation. Therefore, a solution is needed that makes it possible to ease the integration of receptors beads in an analytical device.

SUMMARY

According to a first aspect, the present invention is embodied as a microfluidic chip. The chip comprises a main microfluidic channel, on one side of the chip, and a bead integration system. The bead integration system is arranged on the same side of the chip. It comprises an auxiliary microfluidic channel transverse to and in fluidic communication with the main microfluidic channel, so as to form an intersection therewith. The intersection is delimited by structural elements arranged in the main microfluidic channel. The structural elements are configured to retain, at said intersection, beads flowed in a bead suspension liquid advancing in said auxiliary microfluidic channel and passing the intersection. In addition, such structural elements are configured to let liquid advancing in the main microfluidic channel pass the intersection through the structural elements.

The above solution makes it possible to ease and accelerate the integration of beads, which typically comprise receptors. For instance, the above device and correspondingly the present integration methods do not require centrifugation to pack beads or sedimentation, which are time consuming steps. Beads can be loaded at a distance from the main channel, without the necessity to locally dispense beads directly in the main channel. Bead integration can thus easily and quickly be achieved, e.g., within minutes, and possibly unattended.

In embodiments, the structural elements comprise protruding elements, which protrude from a lower wall of the main microfluidic channel. Such elements may for example be pillars, which are simple to pattern.

The protruding elements can extend along two parallel lines across the main microfluidic channel, which lines partly delimit said intersection. The protruding elements are spaced from each other so as to form openings to let liquid pass therethrough.

For example, the protruding elements have an average diameter between 4 and 18 μm, an average gap between two consecutive protruding elements in each of the two parallel lines being between 2 and 8 μm, the two parallel lines separated by an average distance between 12 and 50 μm.

The main microfluidic channel comprises lateral, anti-wetting capillary structures formed at lateral edge walls of the main microfluidic channel, adjacent to the intersection. This makes it possible to reduce lateral spreading of liquids (coming from the main and/or auxiliary channels) and slow down the progression of the liquid in the main channel.

In embodiments, the chip further comprises: a sample loading area, in fluidic communication with the main microfluidic channel, on one side of the intersection; and a capillary pump, in fluidic communication with the main microfluidic channel, on another side of the intersection. The main microfluidic channel connects the sample loading area to the capillary pump, thereby defining a liquid flow direction D (extending from the sample loading area to the capillary pump). Analysis of liquid can be done in the main channel (or a distribution channel), after this liquid has interacted with, e.g., receptors on the beads trapped at the intersection.

The chip can include two types of auxiliary microfluidic channels (i.e., first and second auxiliary microfluidic channels), one on each side of the main channel. The bead integration system may for instance comprise a bead suspension liquid loading area, on one side of the main microfluidic channel and in fluidic communication therewith, via the first auxiliary microfluidic channel. The bead integration system may further comprise one or more second auxiliary microfluidic channels, on another side of the main microfluidic channel and in fluidic communication with the intersection. The one or more second auxiliary microfluidic channels make it possible to laterally evacuate liquid from the bead suspension liquid that passes the intersection, rather than via the main channel, so as not to hinder analysis of the analyte.

In embodiments, the bead integration system may further comprise an auxiliary capillary pump, on the other side of the main microfluidic channel and in fluidic communication with the intersection via the one or more second auxiliary microfluidic channels. The auxiliary pump helps aspirating liquid from the bead suspension liquid that has passed the intersection.

The first auxiliary microfluidic channel has a first opening to the intersection, and the one or more second auxiliary microfluidic channels respectively have one or more second openings to the intersection. The one or more second openings are provided in a lateral wall of the main microfluidic channel, at a level of the intersection. Each of the one or more second openings can be dimensioned so as to prevent the beads from leaving the intersection and entering the one or more second auxiliary microfluidic channels.

In embodiments, the first auxiliary microfluidic channel extends essentially perpendicularly to a portion of the main microfluidic channel at a level of the intersection. This makes it possible to maximize the distance from the bead suspension liquid loading pad to the intersection (all things being otherwise equal), to avoid contaminating the main channel.

In embodiments, the bead suspension liquid loading area is at least partly surrounded, on said one side of the chip, by anti-wetting structures arranged at a periphery of the bead suspension liquid loading area. This prevents spreading of droplets when loading the bead suspension liquid.

In embodiments, the auxiliary microfluidic channel fluidly connects to the intersection via a tapered portion, which widens towards the intersection. This mitigates the risk for beads to clog at the entrance of the intersection and flow back into the auxiliary channel, toward the bead suspension liquid loading area, when integrating the beads.

The main microfluidic channel successively exhibits (given a liquid flow direction D extending from a liquid loading point in the main microfluidic channel to the intersection): a constriction and a tapered portion, the latter widening towards the intersection. These additional structures help maintaining a stable liquid flow through the intersection, notwithstanding the structural elements delimiting it (which necessarily slow down the liquid progression about the intersection).

In embodiments, the bead integration system further comprises a plurality of auxiliary microfluidic channels. Each of the auxiliary microfluidic channels is transverse to and in fluidic communication with the main microfluidic channel, on one side thereof, so as to form respective intersections therewith. Each of the intersections is delimited by structural elements arranged in the main microfluidic channel. Following same principles as evoked earlier, the structural elements are configured to retain, at each intersection, beads flowed in a bead suspension liquid advancing in a respective auxiliary microfluidic channel and passing said each intersection. The structural elements further make it possible to let liquid advancing in the main microfluidic channel pass each intersection through the structural elements delimiting it. Having a plurality of auxiliary microfluidic channels allows multiplexing.

A plurality of auxiliary microfluidic channels and respective intersections may also be desired to simply widen the total area spanned by the intersections (and thus aggregate more beads), while keeping control on the bead distribution. For example, two adjacent intersections may be partly delimited by a single line of structural elements, i.e., elements protruding from a lower wall of the main microfluidic channel.

In embodiments involving multiplexing, the intersections are more distant, i.e., two consecutive intersections may rather be partly delimited by respective pairs of parallel lines of structural elements (again protruding from a lower wall of the main microfluidic channel), so as for each of the pairs of parallel lines of structural elements to partly delimit a single one of the intersections.

The present microfluidic chips may be provided with beads trapped therein, at the intersection(s). In embodiments, the trapped beads form essentially a single layer of beads. To that aim, the main microfluidic channel and the auxiliary channel may have essentially a same depth, which is less than twice an average diameter of the beads. In embodiments, the chip is partly sealed with a film covering the intersection. The film may for example be a dry film resist, which can easily be laminated on top of the chip to seal the latter.

According to another aspect, the invention is embodied as a method for integrating receptors in a microfluidic chip according to embodiments as discussed herein. This method basically comprises: loading a bead suspension liquid in the auxiliary microfluidic channel, for the bead suspension liquid to advance in said auxiliary microfluidic channel and pass the intersection, such that beads in said bead suspension liquid get trapped at said intersection. The beads comprise the receptors.

In embodiments, the method further comprises partly sealing the chip with a film covering the intersection. As evoked earlier, in embodiments, the film is a dry film resist, which is laminated to partly seal the chip.

According to a final aspect, the invention is embodied as a method of using a microfluidic chip according to embodiments as discussed above, wherein the trapped beads comprise receptors. The method comprises loading a liquid comprising analytes in the main microfluidic channel, for this liquid to advance along the main microfluidic channel, pass the intersection and interact thereat with receptors of the trapped beads.

Devices and methods embodying the present invention will now be described, by way of non-limiting examples, and in reference to the accompanying drawings.

Figure 1:
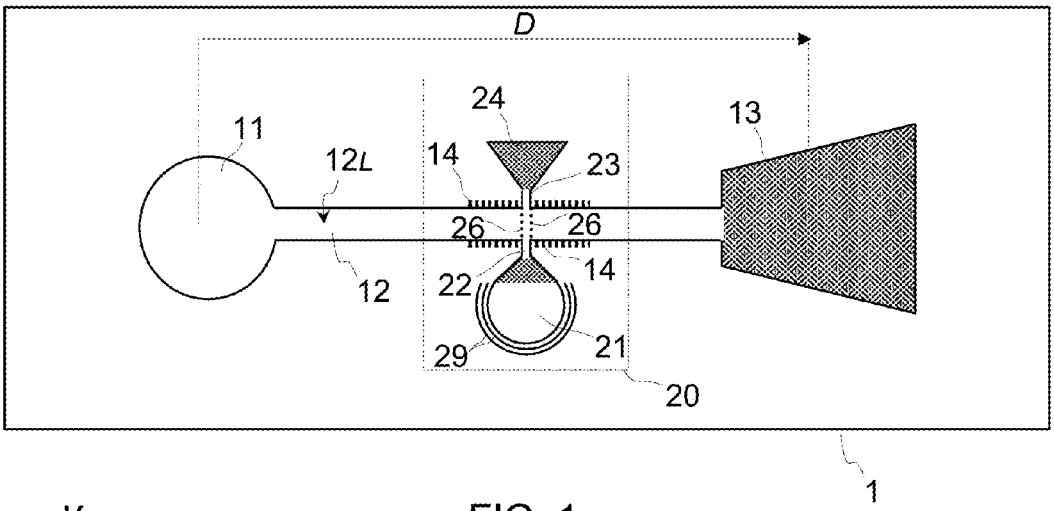
FIG. 1 is a top view of a microfluidic chip according to embodiments.

The accompanying drawings illustrate simplified representations of devices or parts thereof, as involved in embodiments. Technical features depicted in the drawings are not necessarily to scale. Identical or functionally similar elements in the figures have been allocated the same numeral references, unless otherwise indicated.

DETAILED DESCRIPTION

The following description is structured as follows. First, general embodiments and high-level variants are described (sect. 1). The next section addresses more specific embodiments and technical implementation details (sect. 2).

1. General Embodiments and High-Level Variants

In reference to FIGS. 1-4, an aspect of the invention is first described, which concerns a microfluidic chip 1. The chip 1 basically comprises a main microfluidic channel 12 and a bead integration system 20. The main microfluidic channel 12 is on one side of the chip 1. The bead integration system 20 is arranged on the same side of the chip 1.

Figure 2:
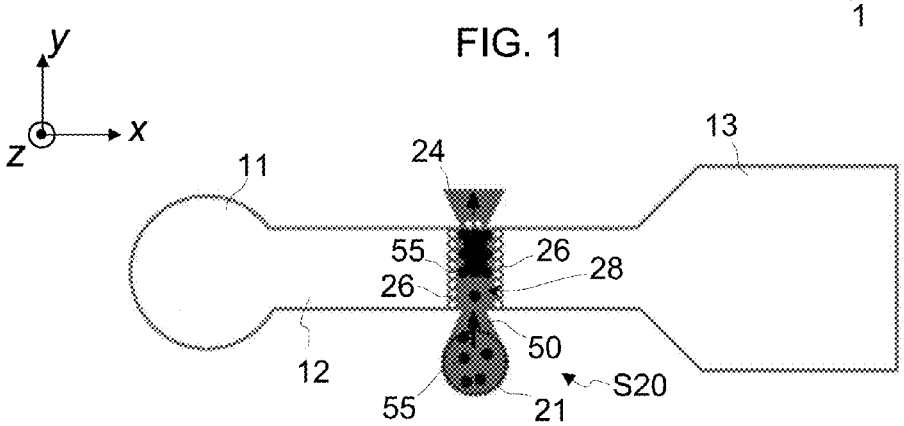
FIGS. 2 and 3 are top views of a similar device, which illustrate the bead integration (FIG. 2) and the interaction of the analyte liquid with the integrated beads (FIG. 3), as in embodiments.
Figure 3:
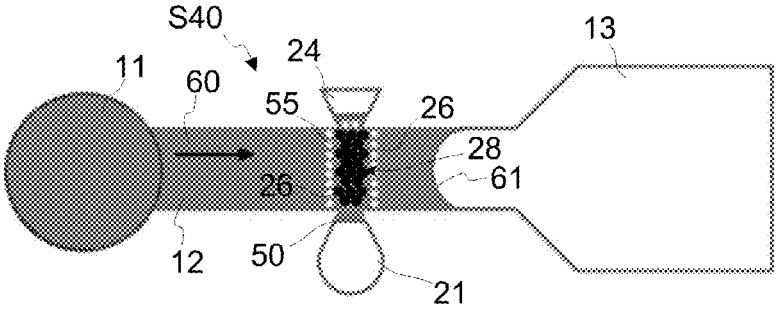

The bead integration system 20 notably comprises an auxiliary microfluidic channel 22. As discussed later in detail, it may in fact comprise a plurality of auxiliary channels, on one or each side of the main channel 12. An auxiliary channel 22 is arranged transversely (e.g., perpendicularly) to the main channel 12 and is in fluidic communication therewith, so as to form an intersection 28, as seen in FIGS. 1-3. Channels 12, 22, 23 are all in-plane, on a same side of the device 1.

The intersection 28 is delimited by structural elements 26, which are arranged in the main microfluidic channel 12. The structural elements 26 have two functions. First, they are configured to retain beads at the intersection 28. That is, when beads 55 are introduced in the auxiliary channel 22, in a bead suspension liquid 50, this liquid advances in the auxiliary channel 22 toward the intersection 28, and then passes the intersection 28. Beads reaching the intersection 28 get trapped therein as they are retained at the intersection 28, while excess liquid 50 can be evacuated via the main channel 12 or via one or more other auxiliary channels 23 on the other side of the main channel 12. In addition, the structural elements 26 are configured so as to let an analyte liquid 60 advancing in the main microfluidic channel 12 reach into and pass the intersection 28, through the structural elements 26, so as to interact with, e.g., receptors on the trapped beads.

The present solutions make it possible to ease and quicken the integration of beads 55 in the device 1. They further make it unnecessary to resort to local dispensing methods, e.g., of a solution containing receptors on porous media such as paper or cellulose. Such methods mostly lead to a lack of resolution and uneven receptor density, which hinder multiplexing, miniaturization, and signal quantitation. In addition, present devices and methods do not require centrifugation to pack beads (as routinely used for packing beads in analytical devices) or sedimentation (as often used to pack beads in chromatography columns), which operations are time consuming. On the contrary, the present approach typically allows bead integration within minutes, if not seconds.

Embodiments discussed herein further avoid issues in terms of, e.g., spreading of liquids, drying artifacts, aggregation and uneven distribution of receptors, as encountered in prior art solutions. I.e., the present approach allows a clean integration of beads.

As for instance seen in FIG. 1: the microfluidic chip 1 typically comprises a sample loading area 11, in fluidic communication with the main channel 12 on one side of the intersection 28, to ease introduction of a liquid sample (an analyte) in the chip 1. On the other side of the intersection 28, a capillary pump 13 will in embodiments be provided in fluidic communication with the main channel 12. The main microfluidic channel 12 accordingly connects the sample loading area 11 to the capillary pump 13, via the intersection 28, which allows a fully passive operation of the chip 1. There is no need of external pumps, which makes present devices 1 amenable to point-of-care diagnostics. As seen in FIG. 1, the liquid flow direction D of the liquid sample 60 in the main channel 12 extends from the sample loading area 11 to the capillary pump 13. Each of the designs of FIGS. 1-9 assumes a liquid flow direction D along the x-axis.

In embodiments, the structural elements 26 comprise protruding elements. Such elements 26 in embodiments protrude from a lower wall 12L of the main microfluidic channel 12, although they may also protrude from an upper seal or lid. Yet, providing such elements 26 directly on the main channel 12 makes it much easier to assemble and obtain accurate placement of these elements around an intersection 28. Such elements 26 may for instance be shaped as pillars, as assumed in FIG. 4, as pillars are relatively simple objects to pattern. Other structures 26 may nevertheless be contemplated, with openings or apertures, so as to let liquid 60 pass therethrough. In variants, structures formed by a rough surface (possibly patterned) around the area 28 may serve a same purpose. Best, however, is to use clean, protruding structures 26. Such structures can notably be patterned using photolithography, direct laser writing, 3D printing, or replication methods based on hot embossing and injection molding techniques.

As further seen in FIGS. 1-4, the protruding elements 26 in embodiments extend along two parallel lines across the main microfluidic channel 12. The lines drawn by elements 26 partly delimit an intersection 28, laterally (along the y-axis). Other structural elements contribute to delimit an intersection 28, e.g., lateral walls 121 of the main channel 12, as implicit from the present geometry. The protruding elements 26 are spaced from each other so as to form openings (apertures) and let liquid 60 pass therethrough.

In terms of dimensions, the protruding elements 26 need be dimensioned consistently with the beads 55 and the area desired for an intersection 28. This also depends on the quantity of beads (and therefore the receptors) and the flow rate and concentration of the analyte 60 needed by the tests to be performed by the device 1. The dimensions of the main channel 12 need be accordingly designed. As one understands, the dimensions of the main structural elements 12, 22, 26, 28 are interrelated and may need be jointly optimized, a thing that can be done using trial-and-error methods. For example, using beads that typically have an average diameter of 10 μm, the protruding elements 26 may have an average diameter that is between 4 and 18 μm, for example of 8 μm, for them to act as a robust enough fence and retain the beads. Meanwhile, the average gap (along the y-axis) between two consecutive elements 26 in each of the two parallel lines they form (e.g., as measured between closest peripheral apices of two consecutive elements 26) may typically be between 2 and 8 μm, for example of 4 μm. The two parallel lines are for example separated by an average distance that is between 12 and 50 μm, e.g., of 25 μm, to allow one or more columns of beads to aggregate at the intersection 28.

Figure 6:
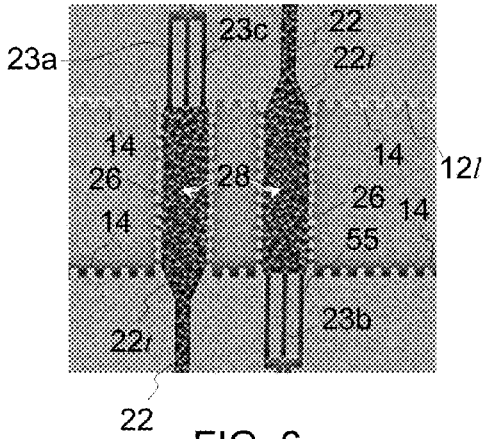
FIG. 6 is an experimental image of a top view of a microfluidic chip having two intersections for trapping beads, according to embodiments.
Figure 7:
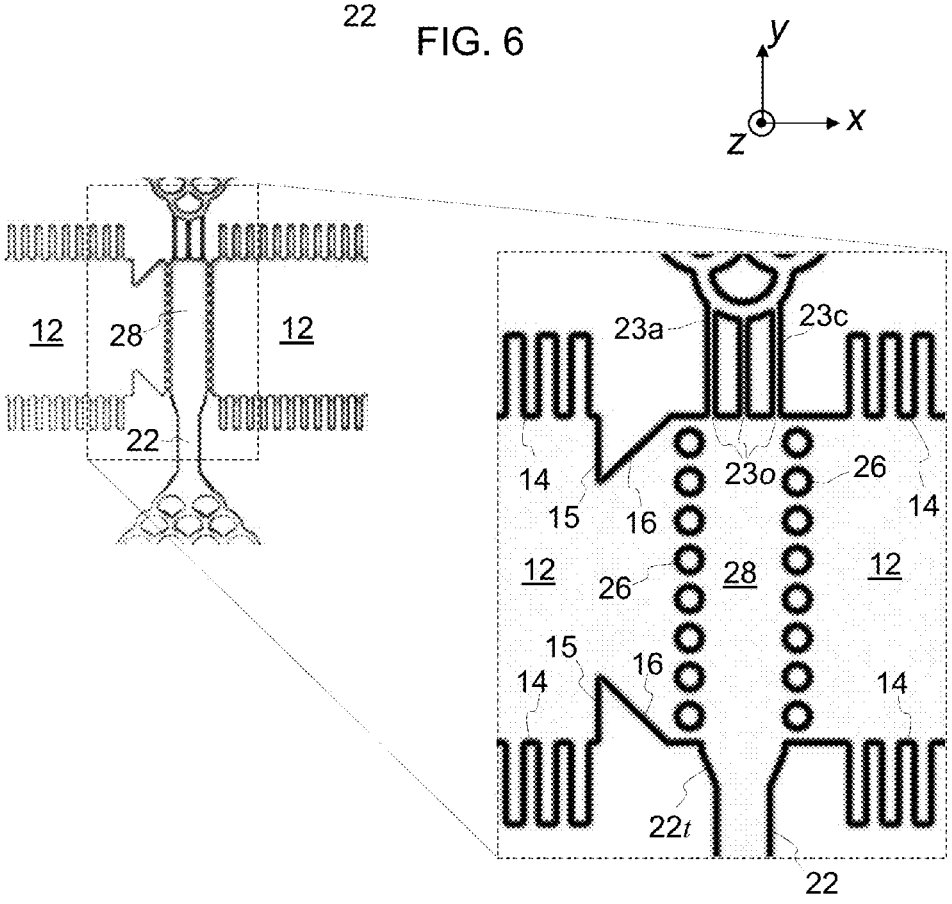
FIG. 7 shows an experimental image of a top view of another microfluidic chip. The enlargement image shows structural details about an intersection between an auxiliary microfluidic channel and a main channel of the chip, as in embodiments.

Referring to now to FIGS. 1, 6, and 7: embodiments of the microfluidic chip 1 involve a channel 12 that is laterally structured at the level of an intersection 28. Namely, the main microfluidic channel 12 comprises lateral, anti-wetting capillary structures 14, which are formed at lateral edge walls 121 of the main channel 12, adjacent to an intersection 28. The anti-wetting capillary structures 14 may for instance be patterned as a lateral grating of, e.g., toothed or indented structures 14, as best seen in FIGS. 6 and 7. The lateral structures 14 need be adequately dimensioned and spaced, so as to exhibit adequate angles to repel aqueous liquids by capillarity. This makes it possible to lessen lateral spreading of liquids 50 and 60 in the vicinity of an intersection 28.

The bead suspension liquid 50 should indeed in embodiments not spread too much in the main channel 12 as the latter is typically used for analysis; the liquid 50 would indeed hinder such an analysis. In addition, when the analyte 60 fills the channel 12, the anti-wetting capillary structures 14 slow down the liquid meniscus 61, i.e., it curbs the lateral progression of the meniscus 61 and mitigates the risk of asymmetric filling of the channel 12 (and thus of formation of air bubbles). For example, if salt crystals are left in the channel 12 after drying (at fabrication), such crystals might accelerate the filling in the main channel 12 as they are very polar. Salt crystals may, in practice, accumulate in the lateral corners of the main channel 12. A similar effect could perhaps be obtained by chemically processing lateral surfaces of the channel 12 in the vicinity of an intersection 28. However, patterning lateral, anti-wetting structures 14 is much simpler, from a fabrication point-of-view.

Figure 4:
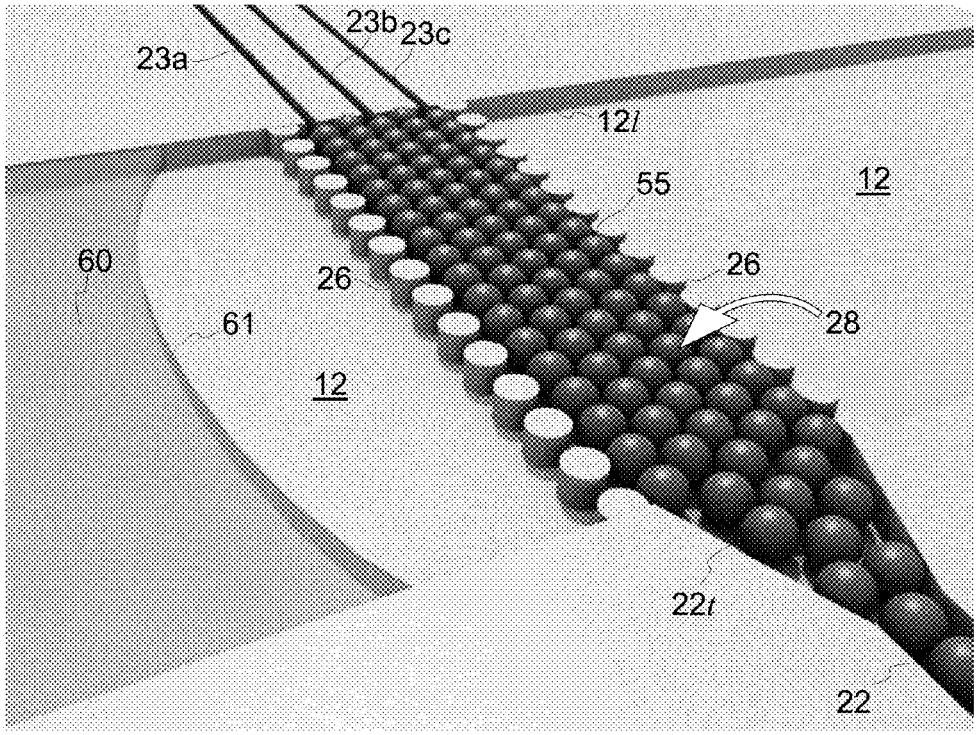
FIG. 4 is a 3D view of a device as in FIG. 1, focusing on an intersection between an auxiliary microfluidic channel and a main microfluidic channel of the chip, where beads are trapped.

As evoked earlier, embodiments of the microfluidic chip 1 involve a plurality of auxiliary channels 22, 23 (23*a-c*). The auxiliary microfluidic channel 22 may for instance be referred to as a first auxiliary channel 22 (or channel portion). As illustrated in FIGS. 4, 6 and 7, the bead integration system 20 may further comprise a bead suspension liquid loading area 21, on one side of the main microfluidic channel 12 and in fluidic communication therewith, i.e., via an auxiliary channel 22. This eases the introduction of the bead suspension liquid 50, which can be done at a safe distance from the main channel 12, so as to prevent spreading of liquids and drying artefacts. In that respect, the auxiliary channel 22 in embodiments extends perpendicularly to the main channel 12 at the level of the intersection 28, in order to maximize the distance (all things being otherwise equal) from the loading area 21 to the intersection 28.

Several channel portions 22, 23 may be present. The bead integration system 20 may notably comprise one or more second auxiliary microfluidic channels 23, 23*a-c*, on the other side of the main channel 12, in fluidic communication with the intersection 28. The second auxiliary microfluidic channels 23, 23*a-c* makes it possible to laterally evacuate liquid 50 from the bead suspension liquid when the latter passes an intersection 28, rather than via the main channel 12, so as not to hinder the analysis of the analyte liquid. A plurality of first auxiliary channels 22 may be needed for multiplexing purposes (as later discussed in reference to FIG. 8) or simply to widen the bead suspension liquid inlet (as in FIG. 9*h*). Having several second auxiliary channels 23*a-c* for each first auxiliary channel 22 allows the width of channels 23*a-c* to be reduced (and prevent beads from entering such channels 23*a-c*).

As further illustrated in FIGS. 1-3, the bead integration system 20 in embodiments include an auxiliary capillary pump 24, opposite to the bead suspension liquid loading area 21, with respect to the main channel 12. The auxiliary capillary pump 24 is in fluidic communication with the intersection 28 via one or more second auxiliary channels 23, 23*a-c*. I.e., the auxiliary microfluidic channel 22 connects the bead suspension liquid loading area 21 (e.g., a liquid loading pad) to the main channel 12, at an intersection 28, to which the auxiliary capillary pump 24 is fluidly connected too, via one or more second auxiliary channels 23, 23*a-c*.

Again, the auxiliary capillary pump 24 allows a passive system, i.e., the progression of the bead suspension liquid 50 is passively driven by the capillary pump 24, on the other side of the intersection 28. Best results are obtained if the main channel 12 and the auxiliary channels 22, 23 all have a same depth about their intersection 28, which further eases the fabrication process. This further helps to control the quantity of beads inside an intersection. Still, the (wetting) channels 12, 22, 23 also play the role of passive capillary pumps.

Thanks to passive capillary means 12, 22, 23, 24, the present devices allow unattended bead integration. For instance, after inserting a bead suspension into the bead integration system 20, beads will self-assemble at the intersection 28 while the suspension liquid will gradually evaporate. This allows for very efficient integration of beads and manufacturing of the microfluidic device, e.g., on a batch level. That is, parallel bead integration can be achieved using a plurality of devices placed on a tray, or using roll-to-roll fabrication techniques. Drying of liquid 50 can also be achieved using ovens and controlled ambient conditions (temperature and relative humidity) to balance both the speed at which the excess liquid evaporates and the packing of beads in the intersection 28.

One may want to obtain a single layer of beads 55 crystalized at the intersection(s) 28, to keep better control of the actual number of integrated beads (and therefore the quantity of receptors). According to experiments conducted by the present inventors, a single layer of beads can most easily be obtained with a main channel 12 having a depth of 5 μm and a width of 100 μm, and using a 0.2% solution of 4.5 μm beads, the space between parallel lines of structural elements 26 being between 10 and 25 μm. To help that aim also, the lower wall 12L of the main channel 12 may be patterned at the level of an intersection 28 so as to exhibit bead retention features (e.g., an array of bead trapping holes). This point discussed again in sect. 2.2.

In embodiments as illustrated by FIGS. 4, 6 and 7, the one or more second auxiliary microfluidic channels 23, 23*a-c* have one or more second openings 23*oi*, respectively, to the intersection 28. The second openings 23*o* are provided in the lateral wall 121 of the main channel 12, at a level of the intersection 28A. The first auxiliary microfluidic channel 22 has a first opening 22*t* to the intersection 28 it makes with the main channel 12. Each of the one or more second openings 23*o* is narrower than the first opening 22*t* (as measured along a direction parallel to the liquid flow direction D, i.e., along the x-axis). The second openings (and so the second auxiliary channels) can be dimensioned so as to prevent the beads from leaving the intersection and entering the second auxiliary channels.

As further illustrated in FIGS. 4, 6 and 7, the auxiliary microfluidic channel 22 in embodiments connect to the intersection 28 via a tapered portion 22*t*, which widens towards the intersection 28. This mitigates the risk for beads 55 to clog at the entrance of the intersection 28 or to flow back into the auxiliary channel 22, toward the liquid loading area 21, when integrating the beads.

As best seen in FIG. 7, in embodiments, the main channel 12 successively exhibits a constriction 15 and a tapered portion 16. I.e., the tapered portion 16 is patterned immediately after the constriction 15. The tapered portion 16 widens towards the intersection 28. As inventors have realized, consecutive lateral structures 15, 16 help maintaining a stable liquid flow through the intersection 28, notwithstanding the structural elements 26 delimiting the latter, which necessarily disturb the progression of the liquid flow 60 in the main channel. Similar lateral structures can also be seen in FIGS. 9*a-e* and 9*h*. If necessary, a chain of several constriction-taper pairs may be provided, along the liquid flow direction D (from the liquid loading area 11 to the intersection 28).

Typical dimensions for the lateral structures 15, 16 range from 2 μm up to 50 μm. With structures as large as 50 μm, the main channel can be 200 μm wide. Yet, more important than the dimensions of structures 15 and 16 is the angle formed by such structures. By forming an angle of 90 degrees or less, structures 15, 16 will form a capillary barrier against the progression of the liquid toward intersection 28. In other words, the structures 15, 16 will act as a pinning site. Angles of about 45 degrees result in stronger pinning sites than angles between 45 and 90 degrees. Smaller angles may pin liquid as well but these can be significantly more challenging to fabricate, in particular if methods other than lithography are used.

Figure 8:
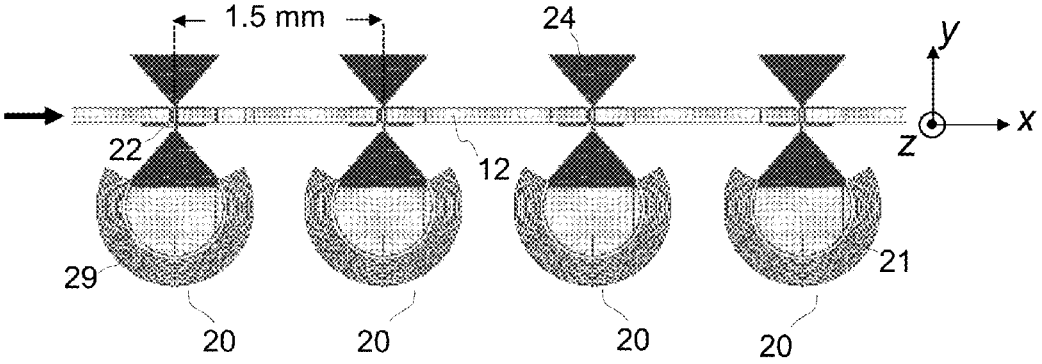
FIG. 8 is an experimental image of a top view of another microfluidic chip, designed for multiplexing, as in embodiments.
Figure 9A:
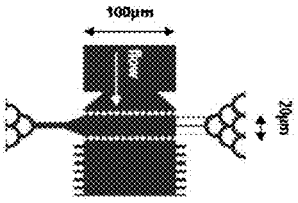
FIG. 9*a* illustrates one of various possible designs of microfluidic chips (top view), according to other embodiments.
Figure 9B:
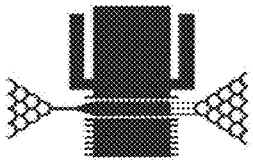
FIG. 9*b* illustrates one of various possible designs of microfluidic chips (top view), according to other embodiments.
Figure 9C:
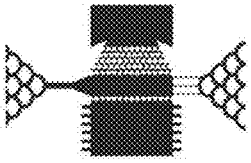
FIG. 9*c* illustrates one of various possible designs of microfluidic chips (top view), according to other embodiments.
Figure 9D:
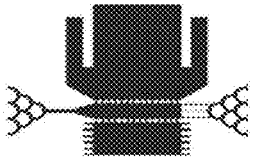
FIG. 9*d* illustrates one of various possible designs of microfluidic chips (top view), according to other embodiments.
Figure 9E:
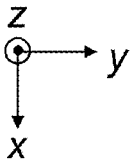
FIG. 9*e* illustrates one of various possible designs of microfluidic chips (top view), according to other embodiments.
Figure 9E:
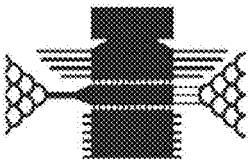
Figure 9F:
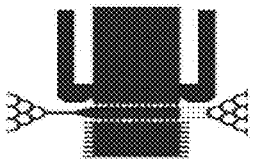
FIG. 9*f* illustrates one of various possible designs of microfluidic chips (top view), according to other embodiments.
Figure 9G:
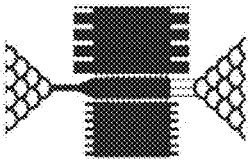
FIG. 9*g* illustrates one of various possible designs of microfluidic chips (top view), according to other embodiments.
Figure 9H:
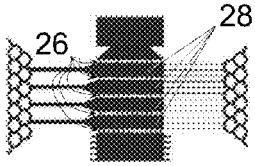
FIG. 9*h* illustrates one of various possible designs of microfluidic chips (top view), according to other embodiments.

Referring now to FIGS. 6, 8, and 9*h*, the bead integration system 20 in embodiments includes a plurality of auxiliary channels 22. Each of the auxiliary channels 22 is transverse (e.g., perpendicular) to and in fluidic communication with the main channel 12, on one side thereof. They form respective intersections 28 with the main channel 12. Each intersection 28 is again delimited by structural elements 26 arranged in the main channel 12, so as to retain beads 55 thereat while allowing sample liquid 60 to reach into and pass each intersection 28. As evoked earlier, this may serve two purposes: it allows multiplexing (as in FIG. 8) or simply to widen the liquid inlet across the main channel 12 (as in FIG. 9*h*).

Referring first to FIG. 9*h*: here two adjacent intersections 28 are partly delimited by a single line of structural elements 26. As before, each line of structural elements 26 may include elements protruding from a lower wall 12L of the main channel 12. This way, adjacent intersections 28 are obtained that widen the total area available for aggregating beads. One may, in variants, simply widen the area spanned by a single intersection 28 (as delimited by parallel lines of structures 26). However, this solution makes it more difficult to keep control on the bead distribution, when the latter aggregate at the intersection. Indeed, one may want to maintain a certain ratio between the distance between parallel lines of structural elements 26 and the bead diameter (e.g., between 2:1 and 3:1), to obtain satisfactory bead distributions in the area 28. Thus, if a wider area 28 is needed, one can do so by patterning several adjacent intersections 28, e.g., separated by one column of pillars 26.

In variants such as depicted in FIG. 8, intersections 28 are at a distance from each other. That is, two consecutive intersections 28 are now laterally delimited by respective pairs of parallel lines of structural elements 26. Again, the latter are in embodiments obtained as elements protruding from the lower wall 12L of the main channel 12. Thus, each pair of parallel lines of structural elements 26 laterally delimits a respective, single one of the intersections 28. This design allows for well-separated multiplexing.

Referring back to FIGS. 2-3 and 5, another aspect of the invention will now be briefly discussed, which concerns methods for integrating receptors in a microfluidic chip 1 as described above. Such methods are made extremely simple, owing to the chip designs considered herein. First, a pristine microfluidic chip 1 (as, e.g., in FIG. 1) is provided, step S10, FIG. 5, without beads integrated yet. Then, a bead suspension liquid 50 is loaded S20 in the auxiliary channel 22, e.g., via a loading pad 21. The beads 55 comprise receptors, to later enable a test. Then, the loaded bead suspension liquid 50 advances in the auxiliary channel 22 toward an intersection 28 and passes the intersection 28 (the liquid evacuates in the main channel or, better, in opposite auxiliary channels 23, e.g., as prompted by the capillary pump 24), such that beads 55 get spontaneously trapped at an intersection 28.

Figure 5:
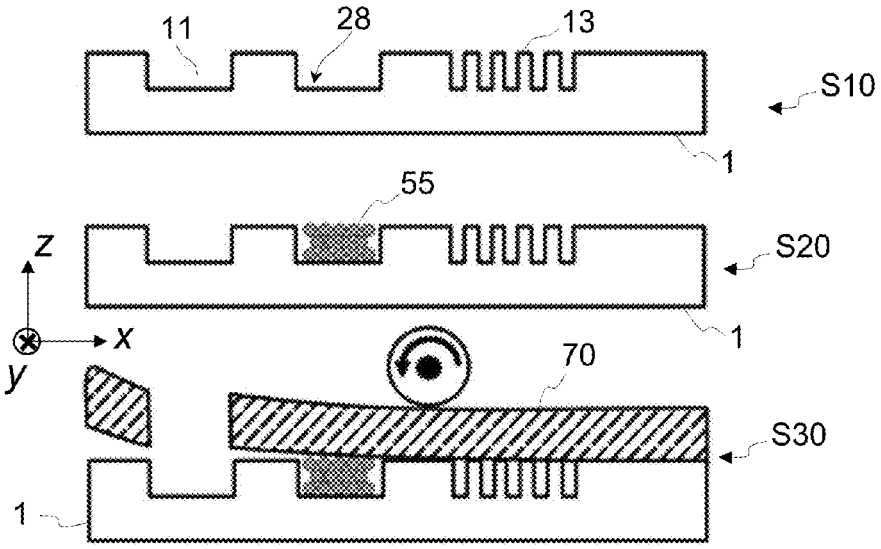
FIG. 5 illustrates steps for fabricating a sealed chip, according to embodiments.

Thus, and as illustrated in FIGS. 5, 6, the present chips 1 may accordingly be provided (as a final product, e.g., ready for testing purposes), with beads 55 laterally trapped at the intersection(s) 28.

As further depicted in FIG. 5, embodiments of such methods further comprise partly sealing S30 the chip 1 with a lid or a film 70, for it to cover the intersection(s) 28, so as to prevent beads to escape the intersections 28 when, e.g., handling, packaging or transporting the chips 1. The film 70 may notably cover the channels 12, 22, 23, the capillary pumps 13, 24, and the loading pad 21. However, an opening will in embodiments leave the liquid loading area 11 accessible. The opening can be predefined in the film 70, prior to lamination. In variants, the film may comprise precut lines corresponding to the desired opening, e.g., with a tab glued thereon to ease removal of the corresponding film portion. The user would simply have to remove the film portion corresponding to the opening to start the test.

One may, in embodiments, want to obtain trapped beads 55 that form essentially a single layer of beads, as assumed in FIG. 4. To that aim, the main channel 12 and the auxiliary channel 22 will in embodiments have a same depth, which is less than twice the average diameter of the beads (e.g., 10 μm), e.g., which is less than 20 μm.

Referring now to FIG. 3, a final aspect of the invention is now described, which concerns methods of using a microfluidic chip 1 as described herein. Assume that a chip 1 comprises beads already integrated therein, e.g., according to a method as described above. The trapped beads 55 typically comprise receptors, for an analyte to react therewith. A user simply has to load S40 a liquid sample 60 comprising one or more types of analytes in the main channel 12. The, the loaded liquid 60 advances in and along the main microfluidic channel 12, passes the intersection 28, interacting thereat with receptors of the trapped beads 55. Liquid 60 then leaves the intersection(s) 28 and keeps on advancing along the main channel 12, e.g., toward a capillary pump 13. Controls and detections can be performed directly on the main channel or on distributary channels, according to known techniques (involving a microscope, a smartphone or electrodes), which need not be discussed here in detail.

The above embodiments have been succinctly described in reference to the accompanying drawings and may accommodate a number of variants. Several combinations of the above features may be contemplated. Examples are given in the next section.

2. Specific Embodiments/Technical Implementation Details 2.1 Point-of-Care Diagnostics, Mobile Health and Security Features Embodiments of the present chips 1 include test devices for diagnostic testing, such as the so-called rapid testing devices or rapid diagnostic test devices. Rapid diagnostic test (RDT) devices are devices used for quick and easy medical diagnostic tests. They typically allow results to be obtained within a few hours or less. They notably include point-of-care (POC) test devices and over-the-counter (OTC) tests.

Such test devices may notably be a portable, e.g., handheld device, such as for example a blood glucose meter, a dipstick or a test kit for detecting one or several analytes (e.g., C-reactive protein, cardiac markers, viral antigens, allergens, genetically modified organisms, pesticides, pollutants, metabolites, cancer biomarkers such as carcinoembryonic antigen and others, therapeutic drugs, drugs of abuse, etc.), or a pregnancy or fertility test. Such devices can also be used for detecting cellular receptors or antibodies (as in the case of serology tests). In general, this invention can be applied to any receptor-ligand assay, including DNA-based assays. For instance, beads can be coated with DNA probes. Such probes can hybridize a DNA complementary target flowing in the main channel. The hybridization can be revealed using a double strand DNA intercalating dye or a labelled DNA reporter strand. More generally, the present devices may be any type of RDT devices (POC or OTC devices). Furthermore, the test devices may be used to perform analyses going beyond medical diagnostic, for example for detecting toxins in water, etc. There are potentially numerous applications for such test devices, as the skilled person may realize. Detection may be done using, e.g., a low-end microscope or smartphone, to enable "mobile" health.

The present devices may furthermore comprise an optical readable medium, wherein the medium comprises a pattern of spots of material arranged on a surface of the device. Said spots may notably be inkjet spotted, to ensure an accurate placement of the spot and reasonable fabrication times. Several patterns may be present, at distinct locations on the device. The patterns accordingly formed may be human and/or machine readable. They may notably encode security information, e.g., a security key, or be designed to reveal a pattern indicating whether the device has already been used. More generally, a security pattern allows information to be encoded directly on the test device, which is therefore harder to imitate or fake, and may thus be useful to detect fake or counterfeited tests or signalize fraudulent tests, e.g., tests which have already used.

In embodiments, the test device further comprises a cover covering the pattern of spots, where the cover is transmissive to light. The material spots forming the pattern are thus located under the cover, which make them harder to reproduce or imitate. The pattern, i.e., a key, may for instance fit in 400 μm-wide channels (whose widths will, in general, be less than 1 mm), structured in a SU-8 3010 surface or a SU-8 3050 surface. The size of the spots is sufficiently small to afford enough key elements. Only few droplets are needed per elements, which result in good optical contrast, with few defects, and so in a well visible key when imaged with a smartphone equipped with an external, low-cost macro lens.

2.2 Fabrication

The surface on which the main flow path 12 is formed is the surface of a material that shall typically be one of the following materials: a polymer (e.g., a SU-8 polymer), silicon dioxide, or glass. Other materials may be contemplated, such as, e.g., a metal coating. However, a metal coating may require a more complex fabrication method (for instance a cleanroom or a complex process), or need toxic precursors.

Conventional fabrication methods can be used to fabricate the present devices, including injection molding and hot embossing. 3D printing can be used as well, although structures 15 and 16 might need to be slightly rounded in this case. Yet, one may in embodiments want to use anisotropic dry etching techniques to obtain precise structures 14, 26 for bead integration.

Single step anisotropic dry etching (e.g., DRIE) of silicon may notably be advantageously used, as they require a single mask only and offer high resolution patterning. In particular, single step isotropic etching of silicon allows undercut and overhanging mask layer to be obtained, to create partially-closed bead integration trenches and channels.

Single step patterning of SU-8 can also be used, which further allows reliable capillary valves to be obtained. Both techniques can be mixed. I.e., reliable valves, microfluidic channels and deep capillary pumps can be obtained thanks to SU-8 (which has high volume capacity), while precise bead integration structures can be obtained by DRIE.

For example, in embodiments, the chip measures 19.5× 9.4 mm2 and comprises loading pads 11, 21, microchannels 12, 22, 23, with electrodes embedded in the main channel 12 or in distributary channels (not shown), capillary pumps 13, 24, air vents, a cover film and electrical contacts mating with a card-edge socket. Silicon substrate is used to leverage the micromachining processes as well as the favorable properties of Si and SiO2, such as channel etching with tapered sidewall profile, hydrophilicity of SiO2 for capillary filling, thermal and chemical stability, mechanical robustness, compatibility of SiO2 surface with many biomolecules, and well-defined and reliable chemical composition.

In the fabrication process, the channels are anisotropically etched in silicon using TMAH and electrically passivated by thermal oxidation. The electrodes are patterned by metal evaporation and lift-off after conformal coating and patterning of a single-layer photoresist. Prior to metal deposition, a short isotropic SiO2 etching is introduced to assist lift-off and to recess the electrodes. The photolithography parameters are optimized to achieve at least a 5-μm minimum feature size in 20 μm deep trenches. Following the dicing and cleaning steps, a hydrophilic dry-film cover is laminated at 45° C. to seal the microfluidic structures. SEM inspection showed that the cover film perfectly tents over the channels and over the capillary pump. The electrodes showed minimized edge defects and very flat surface topography owing to the recessing step.

In variants, electrodes are patterned on a flat Si surface having a SiO2 passivation layer using a metal lift-off or a metal etching process. Microfluidic structures are then patterned using an additive process, such as photolithographic patterning of SU-8 or dry-film resist. Although not preferred, electrodes can also be patterned on the cover substrate (or film) and then bonded to the substrate carrying microfluidic structures using a chip or wafer bonding technique (e.g., film lamination, anodic bonding, direct bonding, thermoplastic bonding, adhesive bonding, etc.). In case there is already a chip functionality that requires electrodes (e.g., microheaters, electrodes for dielectrophoresis or electrowetting, or electrodes for amperometric, impedimetric, or electrochemical sensing, etc.), electrodes for liquid monitoring can be patterned together with the other electrode patterns or conductive layers in general.

Methods described herein can be used in the fabrication of microfluidic devices, notably wafer-based chips. The resulting chips can for instance be distributed by the fabricator in raw wafer form (that is, as a single wafer that has multiple unpackaged chips), as a bare die, or in a packaged form. In the latter case the chip is mounted in a single chip package (such as a plastic carrier) or in a multichip package. In any case the chip can then be integrated with other chips, or other microfluidic elements (tubing ports, pumps, etc.) even if applications to autonomous chips are preferred, as part of either (a) an intermediate product or (b) an end product.

While the present invention has been described with reference to a limited number of embodiments, variants and the accompanying drawings, it will be understood by those skilled in the art that various changes may be made and equivalents may be substituted without departing from the scope of the present invention. In particular, a feature (device-like or method-like) recited in a given embodiment, variant or shown in a drawing may be combined with or replace another feature in another embodiment, variant or drawing, without departing from the scope of the present invention. Various combinations of the features described in respect of any of the above embodiments or variants may accordingly be contemplated, that remain within the scope of the appended claims. In addition, many minor modifications may be made to adapt a particular situation or material to the teachings of the present invention without departing from its scope. Therefore, it is intended that the present invention not be limited to the particular embodiments disclosed, but that the present invention will include all embodiments falling within the scope of the appended claims. In addition, many other variants than explicitly touched above can be contemplated. For example, the present claimed microfluidic chips may be fabricated as a microfluidic probe.

What is claimed is:

1. A microfluidic chip, comprising:

a main microfluidic channel, on one side of the chip; and a bead integration system arranged on said one side of the chip, the bead integration system comprising:

a first auxiliary microfluidic channel transverse to and in fluidic communication with the main microfluidic channel, so as to form an intersection therewith, the first auxiliary microfluidic channel having a first opening to the intersection, the first auxiliary microfluidic channel being on one side of the main microfluidic channel; and more than one second auxiliary microfluidic channels in fluidic communication with the intersection, each of the more than one second auxiliary microfluidic channels respectively having a second opening to the intersection, each of the second openings provided in a lateral wall of the main microfluidic channel, each of the second openings being narrower than the first opening, the more than one second auxiliary microfluidic channels being on another side of the main microfluidic channel, the intersection delimited by structures arranged in the main microfluidic channel, the structures to:

retain, at said intersection, beads flowed in a bead suspension liquid advancing in said first auxiliary microfluidic channel and passing the intersection to the second auxiliary microfluidic channels; and let liquid advancing in the main microfluidic channel pass the intersection through the structures.

2. The microfluidic chip of claim 1, wherein:

the structures comprise protrusions, the latter protruding from a lower wall of said main microfluidic channel.

3. The microfluidic chip of claim 2, wherein:

the protrusions extend only along two parallel lines across the main microfluidic channel, which lines partly delimit said intersection, wherein the protrusions are spaced from each other so as to form openings to let liquid pass therethrough.

4. The microfluidic chip of claim 3, wherein:

the protrusions have an average diameter between 4 and 18 μm, an average gap between two consecutive protrusions in each of the two parallel lines being between 2 and 8 μm, the two parallel lines separated by an average distance between 12 and 50 μm.

5. The microfluidic chip of claim 1, wherein:

the main microfluidic channel comprises lateral, anti-wetting capillary structures formed at lateral edge walls of the main microfluidic channel, adjacent to the intersection.

6. The microfluidic chip of claim 1, wherein the chip further comprises:

a sample loading area, in fluidic communication with the main microfluidic channel, on one side of the intersection; and a capillary pump, in fluidic communication with the main microfluidic channel, on another side of the intersection, whereby the main microfluidic channel connects the sample loading area to the capillary pump, thereby defining a liquid flow direction D that extends from the sample loading area to the capillary pump.

7. The microfluidic chip of claim 1, wherein:

the bead integration system further comprises:

a bead suspension liquid loading area, on the one side of the main microfluidic channel and in fluidic communication therewith, via the first auxiliary microfluidic channel.

8. The microfluidic chip of claim 7, wherein the bead integration system further comprises:

an auxiliary capillary pump, on said another side of the main microfluidic channel and in fluidic communication with the intersection via the more than one second auxiliary microfluidic channels.

9. The microfluidic chip of claim 7, wherein:

the first auxiliary microfluidic channel extends essentially perpendicularly to a portion of the main microfluidic channel at a level of the intersection.

10. The microfluidic chip of claim 7, wherein:

the bead suspension liquid loading area is at least partly surrounded, on said one side of the chip, by anti-wetting structures arranged at a periphery of the bead suspension liquid loading area.

11. A microfluidic chip, comprising:

a main microfluidic channel, on one side of the chip; and a bead integration system arranged on said one side of the chip, the bead integration system comprising:

a first auxiliary microfluidic channel transverse to and in fluidic communication with the main microfluidic channel, so as to form an intersection therewith;

one or more second auxiliary microfluidic channels in fluidic communication with the intersection; and a bead suspension liquid loading area, on one side of the main microfluidic channel and in fluidic communication therewith, via the first auxiliary microfluidic channel, the first auxiliary microfluidic channel being between the bead suspension liquid loading area and the intersection;

the first auxiliary microfluidic channel fluidly connected to the intersection via a tapered portion, which widens towards the intersection, the tapered portion included in the first auxiliary microfluidic channel, the intersection delimited by structures arranged in the main microfluidic channel, the structures to:

retain, at said intersection, beads flowed in a bead suspension liquid advancing from said first auxiliary microfluidic channel to the tapered portion that widens towards the intersection and then to the intersection and passing the intersection; and let liquid advancing in the main microfluidic channel pass the intersection through the structures.

12. A microfluidic chip of claim 1, comprising:

a main microfluidic channel, on one side of the chip;

a bead integration system arranged on said one side of the chip, the bead integration system comprising:

a first auxiliary microfluidic channel transverse to and in fluidic communication with the main microfluidic channel, so as to form an intersection therewith; and one or more second auxiliary microfluidic channels in fluidic communication with the intersection; and a sample loading area, in fluidic communication with the main microfluidic channel, on one side of the intersection, the main microfluidic channel being between the sample loading area and the intersection; and the intersection delimited by structures arranged in the main microfluidic channel, the structures to:

retain, at said intersection, beads flowed in a bead suspension liquid advancing in said first auxiliary microfluidic channel and passing the intersection; and let liquid advancing in the main microfluidic channel pass the intersection through the structures, wherein:

the main microfluidic channel successively exhibits, in a direction extending from the sample loading area to the intersection: a constriction and a tapered portion, the latter widening towards the intersection.

13. The microfluidic chip of claim 1, wherein:

the bead integration system further comprises a plurality of the first auxiliary microfluidic channels, each transverse to and in fluidic communication with the main microfluidic channel, on the one side thereof, so as to form respective intersections therewith, each of the intersections delimited by structures arranged in the main microfluidic channel, the structures to:

retain, at said each of the intersections, beads flowed in a bead suspension liquid advancing in a respective one of the first auxiliary microfluidic channels and passing said each of the intersections; and let liquid advancing in the main microfluidic channel pass said each of the intersections through the structures delimiting it.

14. The microfluidic chip of claim 13, wherein:

two adjacent intersections of said respective intersections are partly delimited by a single line of structures, the latter comprising protrusions protruding from a lower wall of the main microfluidic channel.

15. The microfluidic chip of claim 13, wherein:

two consecutive intersections of said respective intersections are partly delimited by respective pairs of parallel lines of structures, the latter comprising protrusions protruding from a lower wall of the main microfluidic channel, so as for each of the pairs of parallel lines of structures to partly delimit a single one of the intersections.

16. The microfluidic chip of claim 1, wherein:

the chip further comprises beads trapped at the intersection.

17. The microfluidic chip of claim 16, wherein:

the trapped beads form essentially a single layer of beads, the main microfluidic channel and the auxiliary channel having a same depth, which is less than twice an average diameter of the beads.

18. The microfluidic chip of claim 16, wherein:

the chip is partly sealed with a film covering the intersection; and said film is a laminated dry film resist.

19. A method for integrating receptors in a microfluidic chip according to claim 1, the method comprising:

loading a bead suspension liquid in the first auxiliary microfluidic channel, for the bead suspension liquid to advance in said first auxiliary microfluidic channel and pass the intersection, such that beads in said bead suspension liquid get trapped at said intersection, wherein the beads comprise said receptors.

20. The method according to claim 19, wherein the method further comprises:

partly sealing the chip with a film covering the intersection, wherein partly sealing the chip comprises laminating the film, the latter being a dry film resist.

21. The microfluidic chip of claim 16, wherein:
the trapped beads comprise receptors,
the method comprising:
loading a liquid comprising analytes in the main microfluidic channel, for this liquid to advance along the main microfluidic channel, pass the intersection and interact thereat with receptors of the trapped beads.

22. The microfluidic chip of claim 1, wherein:
each of the more than one second auxiliary microfluidic channels extends essentially perpendicularly to a portion of the main microfluidic channel at a level of the intersection.

23. The microfluidic chip of claim 22, wherein:
each of the second auxiliary microfluidic channels has a reduced width that prevents the beads from entering the second auxiliary microfluidic channels.

24. The microfluidic chip of claim 3, wherein:
the second auxiliary microfluidic channels are between the two parallel lines.

* * * * *